US006298924B1

(12) United States Patent
Vaynshteyn et al.

(10) Patent No.: US 6,298,924 B1
(45) **Date of Patent: *Oct. 9, 2001**

(54) SAFETY METHOD AND APPARATUS FOR A PERFORATING GUN

(75) Inventors: Vladimir Vaynshteyn, Sugar Land; Christian C. Spring, Houston, both of TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/641,828

(22) Filed: Aug. 18, 2000

Related U.S. Application Data

(63) Continuation of application No. 09/121,192, filed on Jul. 22, 1998, now Pat. No. 6,105,688.

(51) Int. Cl.[7] ..... E21B 43/117
(52) U.S. Cl. ..... 175/4.54; 175/4.6
(58) Field of Search ..... 175/4.54, 4.56, 175/4.6, 4.55, 1; 166/298, 55, 63, 55.1, 250.09; 181/106, 116, 113

(56) References Cited

U.S. PATENT DOCUMENTS 4,478,294 * 10/1984 Sumner ..... 175/4.56
4,660,638 * 4/1987 Yates, Jr. ..... 166/250
4,867,266 * 9/1989 Martin ..... 181/106
4,895,218 * 1/1990 Chen et al. ..... 181/116
4,928,783 * 5/1990 Crook ..... 181/106
5,278,359 * 1/1994 Miller et al. ..... 181/106

* cited by examiner

*Primary Examiner*—Robert E. Pezzuto
(74) *Attorney, Agent, or Firm*—Trop Pruner & Hu P.C.

(57) ABSTRACT

An apparatus for use in a subterranean well includes a downhole energy source, a first switch, a second switch, a detonator, a first controller and a second controller. The first switch has a first predetermined state to transfer energy from the energy source, and the second switch has a second predetermined state to transfer the energy from the energy source. A detonator receives the energy from the energy source when the first switch and second switches are concurrently in the first and second predetermined states. A first controller independently detects a predetermined stimulus that is transmitted from the surface of the well and causes the first switch to enter to first predetermined state based on the detection by the first controller. A second controller independently detects the predetermined stimulus transmitted from the surface of the well and causes the second switch to enter the second predetermined state based on the detection by the second controller.

29 Claims, 9 Drawing Sheets

| COMMAND | NAME | CODES |
|---|---|---|
| 0 | ID | S1111 1000:1111 0111 |
| 1 | NEXT_GUN | S1111 1001:1111 0110 |
| 2 | FIRE GUN | S1010 1010: 0101 0101 |

*FIG. 5*

| STATUS | NAME | CODES |
|---|---|---|
| 0 | PRESENCE | S1000 |
| 1 | NEXT | S1001 |
| • | • | • |
| • | • | • |
| • | • | • |
| 7 | ISSC_ERROR | S1111 |

*FIG. 6*

| BYTE | NAME | RESPONSE/RANGE |
|---|---|---|
| 0 | Acknowledge | S00001000 |
| 1 | Year | 96 TO 199 CON. TO HEX |
| 2 | Week | 1 TO 52 CON. TO HEX |
| 3 | Serial Number | 0 TO 254 CON. TO HEX |
| 4 | Ver High Byte | 1 TO FF CON. TO HEX |
| 5 | Ver Low Byte | 0 TO FF HEX |
| 6 | Checksum_sn | 0 TO FF HEX |

*FIG. 7*

SAFETY METHOD AND APPARATUS FOR A PERFORATING GUN

This application claims priority and is a continuation of U.S. application Ser. No. 09/121,192 filed on Jul. 22, 1998 by Vaynshteyn and Spring, now U.S. Pat. No. 6,105,688.

BACKGROUND

The invention relates to a safety method and apparatus for a perforating gun.

Referring to FIG. 1, a typical perforating gun string 10 may have several perforating guns 12. Each perforating gun 12 may have phased shaped charges 14 that are used to penetrate a casing of a subterranean well and form fractures in surrounding formations to enhance the production of well fluids from these formations. Because the shaped charges 14 may potentially inflict harm if the charges 14 prematurely detonate, several safety mechanisms typically are used to prevent accidental detonation of the shaped charges 14.

For example, the shaped charges 14 may be secondary explosives that, as compared to primary explosives, are very difficult to detonate. To detonate these secondary explosives, the perforating gun string 10 may have a firing head 11 that is associated with each perforating gun 12. In this manner, the firing head 11 may include a detonator 15 that, when activated, detonates a primary explosive to initiate a shockwave on a detonating cord 17 that extends to the shaped charges 14. The shockwave, in turn, propagates down the detonating cord 17 and detonates the shaped charges 14. Because the primary explosive is capable of being detonated by naturally occurring phenomena, extreme care must be exercised to ensure that the primary explosive does not prematurely detonate.

The detonation of the perforating gun 12 may be remotely controlled from the surface of the well. To accomplish this, stimuli may be transmitted downhole to the firing head 11 to cause the detonator 15 to initiate the shockwave on the detonating cord 17. As examples of techniques that are used to transmit the stimuli, an internal passageway of the string 10, an annulus that surrounds the string 10, a tubing of the string 10, or a line (a slickline or a wireline, as examples) extending downhole may all be used. Other techniques may also be used to transmit command stimuli downhole.

Detonation of the primary explosive typically requires energy from an energy source, a source that may either be located at the surface of the well or downhole in the perforating gun string 10. If the energy source is at the surface of the well, then an operator may disconnect the energy source until firing of the perforating guns 12 is desired. However, unfortunately for the other case, connection/disconnection of a downhole energy source may present difficulties, as circuitry (not shown) of the firing head 11 must connect/disconnect the energy source. For example, a battery 16 of the string 10 may provide the energy needed to cause the detonator 15 to initiate a shockwave on the detonating cord 17. However, a problem with this arrangement is that the battery 16 is located downhole with the detonator 15. Thus, if the circuitry that couples the battery 16 to the detonator 15 should fail, the shaped charges 14 may be inadvertently detonated.

Thus, there is a continuing need for a downhole safety system to reliably prevent accidental detonation of a perforating gun when an energy source to detonate the gun is located downhole with the gun.

SUMMARY

Generally, in one embodiment, an apparatus for use in a subterranean well includes a downhole energy source, a first switch, a second switch, a detonator, a first controller and a second controller. The first switch has a first predetermined state to transfer energy from the energy source, and the second switch has a second predetermined state to transfer the energy from the energy source. A detonator receives the energy from the energy source when the first switch and second switches are concurrently in the first and second predetermined states. A first controller independently detects a predetermined stimulus that is transmitted from the surface of the well and causes the first switch to enter to first predetermined state based on the detection by the first controller. A second controller independently detects the predetermined stimulus transmitted from the surface of the well and causes the second switch to enter the second predetermined state based on the detection by the second controller.

Generally, in another embodiment, a method for use in a subterranean well includes furnishing a predetermined stimulus downhole and using at least two controllers downhole to independently detect the predetermined stimulus. A downhole energy source is coupled to a detonator based on the detection of the stimulus by all of the at least two controllers.

Other embodiments will become apparent from the following description, from the drawing and from the claims.

BRIEF DESCRIPTION OF THE DRAWING

FIGS. 5, 6 and 7 are charts illustrating information communicated between a fire control circuit and detonators of FIG. 4.

DETAILED DESCRIPTION

Figure 1:
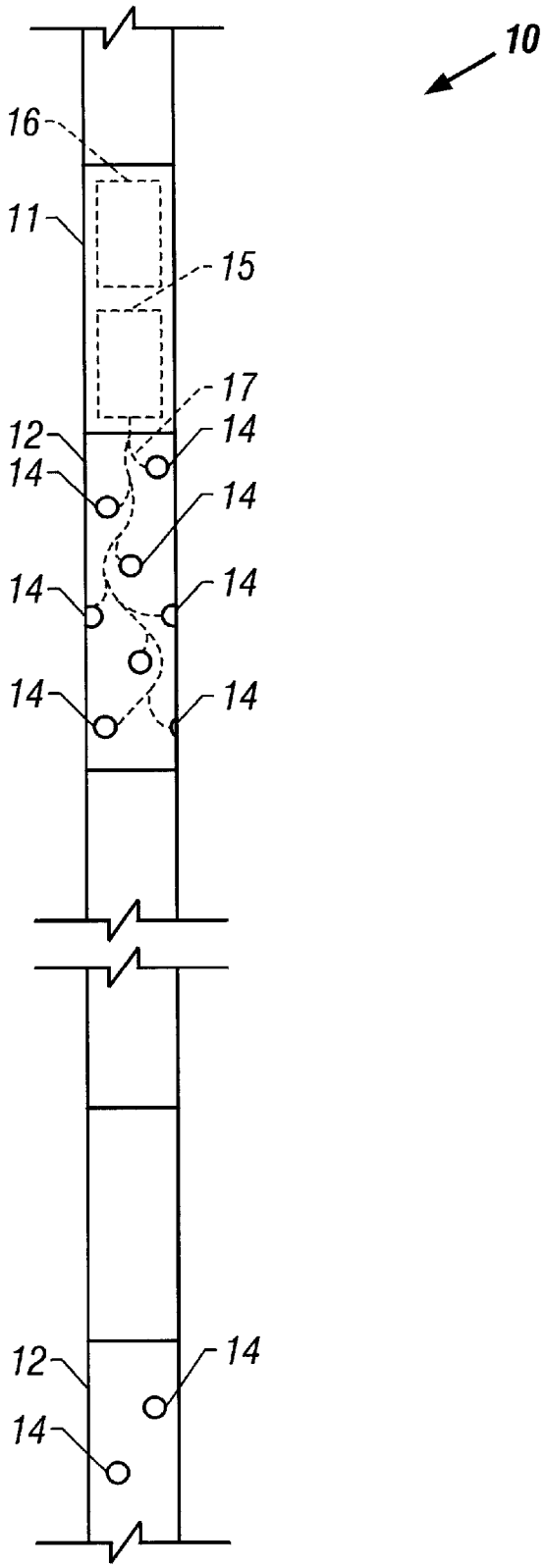
FIG. 1 (Prior Art)
FIG. 1 is a schematic view of a perforating gun string of the prior art.
Figure 2:
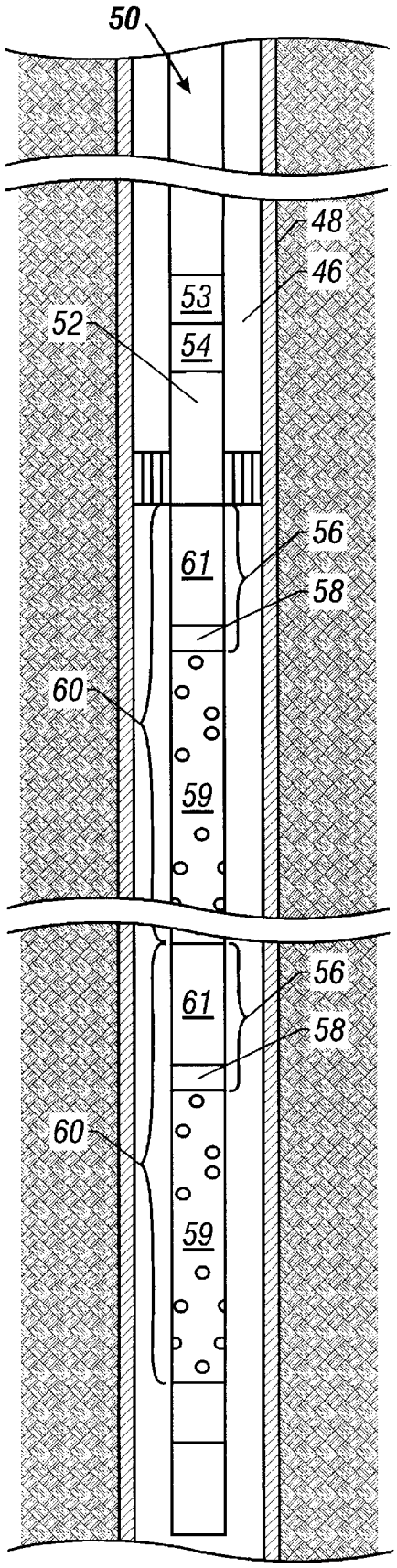
FIG. 2 is a view of a perforating gun string according to an embodiment of the invention.

Referring to FIG. 2, in a subterranean well, an embodiment 50 of a perforating gun string in accordance with the invention uses energy from a battery 52 of the perforating gun string 50 to detonate, or fire, multiple perforating guns 59. Although each perforating gun 59 is fired by an associated electrical detonator 56, the battery 52 remains electrically isolated from the detonators 56 until a unique detonation command (i.e., a command used for no other purpose than detonation) is sent from the surface of the well to begin a firing sequence for the guns 59. To accomplish this, the perforating gun string 50 has a fire control circuit 54 which controls the connection of the battery 52 to the detonators 56. The fire control circuit 54 has redundant circuits (described below) which independently verify the reception of the detonation command before the detonators 56 are connected to the battery 52.

Figure 4:
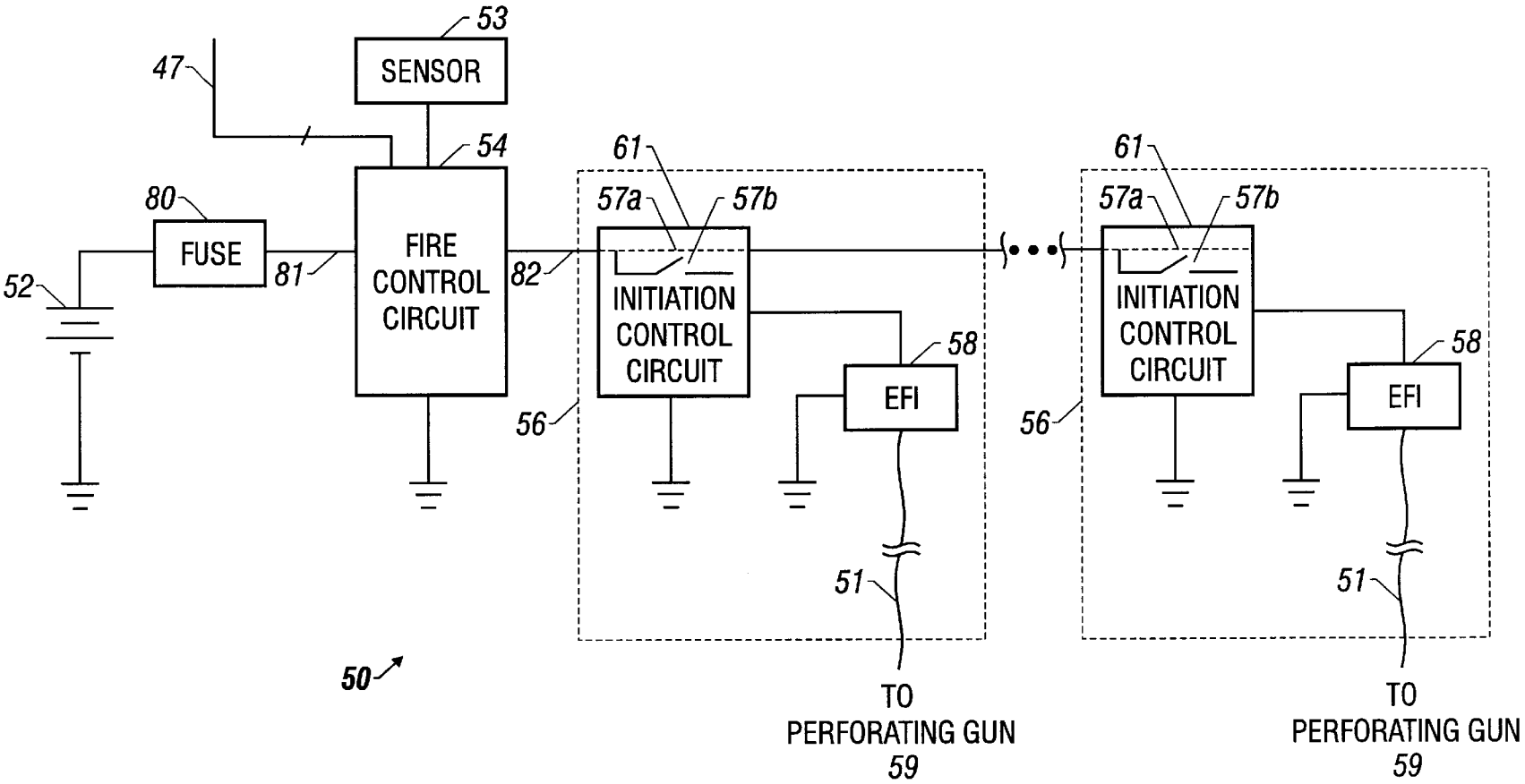
FIG. 4 is an electrical schematic diagram of the perforating gun string of FIG. 2.

In some embodiments, the perforating gun string 50 may include multiple perforating gun assemblies 60. In this manner, each assembly 60 may have one detonator 56 and one perforating gun 59. Referring also to FIG. 4, after reception of the detonation command is verified, the fire control circuit 54 selectively transmits commands (described below) to the detonators 56. In response, an initiation control circuit 61 of a selected detonator 56 fires the associated gun 59 by activating an exploding foil initiator (EFI) 58 of the detonator 56. When activated, the EFI 58 initiates a shockwave on an associated detonating cord 51 that extends to shape charges of the associated gun 59. The shockwave from the detonator cord 51 fires the shape charges, and thus, fires the gun 59.

In some embodiments, remote control is used, as the commands are transmitted to the fire control circuit 54 via stimuli that are transmitted downhole, such as via pressure pulses applied to hydrostatic fluid present in an annulus 46 (see FIG. 2) of the well. The annulus 46 is the annular space accessible from the surface of the well that is between the outside of the string 10 and the interior of a casing 48 of the well. In some embodiments, a duration of the pressure pulse, a pressure of the pressure pulse, and the number of pressure pulses in succession form a signature that uniquely identifies each command. The fire control circuit 54 uses at least one pressure sensor 53 in contact with the hydrostatic fluid in the annulus 46 to receive the commands.

Figure 3:
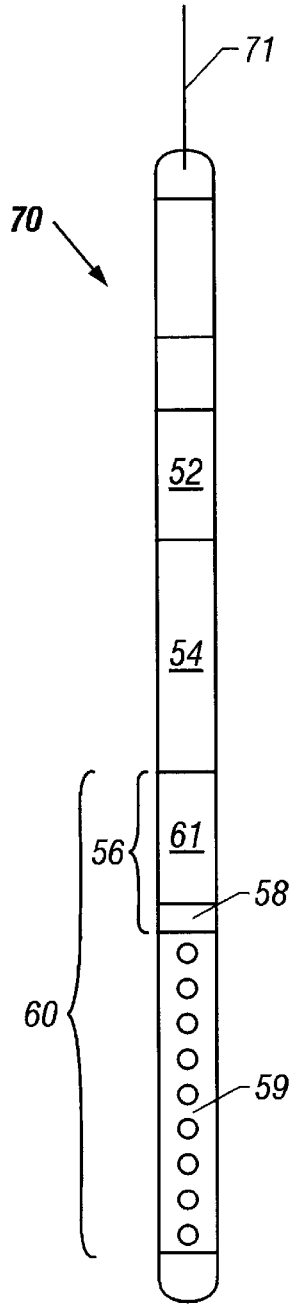
FIG. 3 is a view of a perforating gun tool according to an embodiment of the invention.

Alternatively, in other embodiments, the commands may be transmitted downhole via other types of stimuli. In this manner, stimuli may be transmitted downhole via a passageway of the tubing of the string 10, via a casing of the string 10, or via a downhole line, as a few examples. For the case of the downhole line, a wireline or a slickline, for example, may be used to lower perforating gun assemblies 60 downhole when the assemblies 60 are part of a perforating tool 70 (see FIG. 3). In this manner, the line may impart a predetermined movement (a velocity or an acceleration) on the tool 70. This predetermined movement, in turn, indicates downhole commands, such as the detonation command, that are decoded by a motion sensor (not shown) of the tool 70. Similar to the perforating gun string 50, the tool 70 may have one or more perforating gun assemblies 60, the fire control circuit 54, and the battery 52. The perforating gun tool 70 may be alternatively attached to a coiled tubing which may be used in the ways described above to send stimuli downhole.

Referring back to FIG. 4, the fire control circuit 54 is configured to receive the stimuli transmitted downhole and selectively connect the battery 52 to the detonators 56 only if several conditions are met, as described below. Otherwise, the battery 52 remains isolated from the detonators 56, and the perforating guns 59 cannot be fired. To accomplish this, the fire control circuit 54 is coupled between the battery 52 and a power line 82 extending to the detonators 56. A power line 81 extends between the battery 52 and the fire control circuit 54. If the fire control circuit 54 detects an external fault condition (e.g., the presence of water near circuitry of the tool) or the partial failure of the fire control circuit 54 itself, the fire control circuit 54 shorts the battery 52 to ground which blows a fuse 80 that is serially coupled between the battery 52 and ground. Once the fuse 80 is blown, power from the battery 52 cannot be furnished to the detonators 56 which allows the tool 50 to be safely extracted from the well and serviced.

If no fault conditions exist and the fire control circuit 54 is operating properly, then the fire control circuit 54 monitors for transmitted downhole stimuli to detect a detonation command. In some embodiments, the detonation command is a partial key. When the fire control circuit 54 detects a valid (discussed below) detonation command key, the fire control circuit 54 must generate at least three fire control keys. The fire control circuit 54 does not contain within a complete fire key, but only a partial key. In this manner, the partial detonation command key received from the surface must be combined with the internal partial key to form the fire control keys. The importance of this sequence is to prevent the fire control circuit from accidentally jumping to a subroutine and generating a firing sequence without a valid command.

Figure 9:
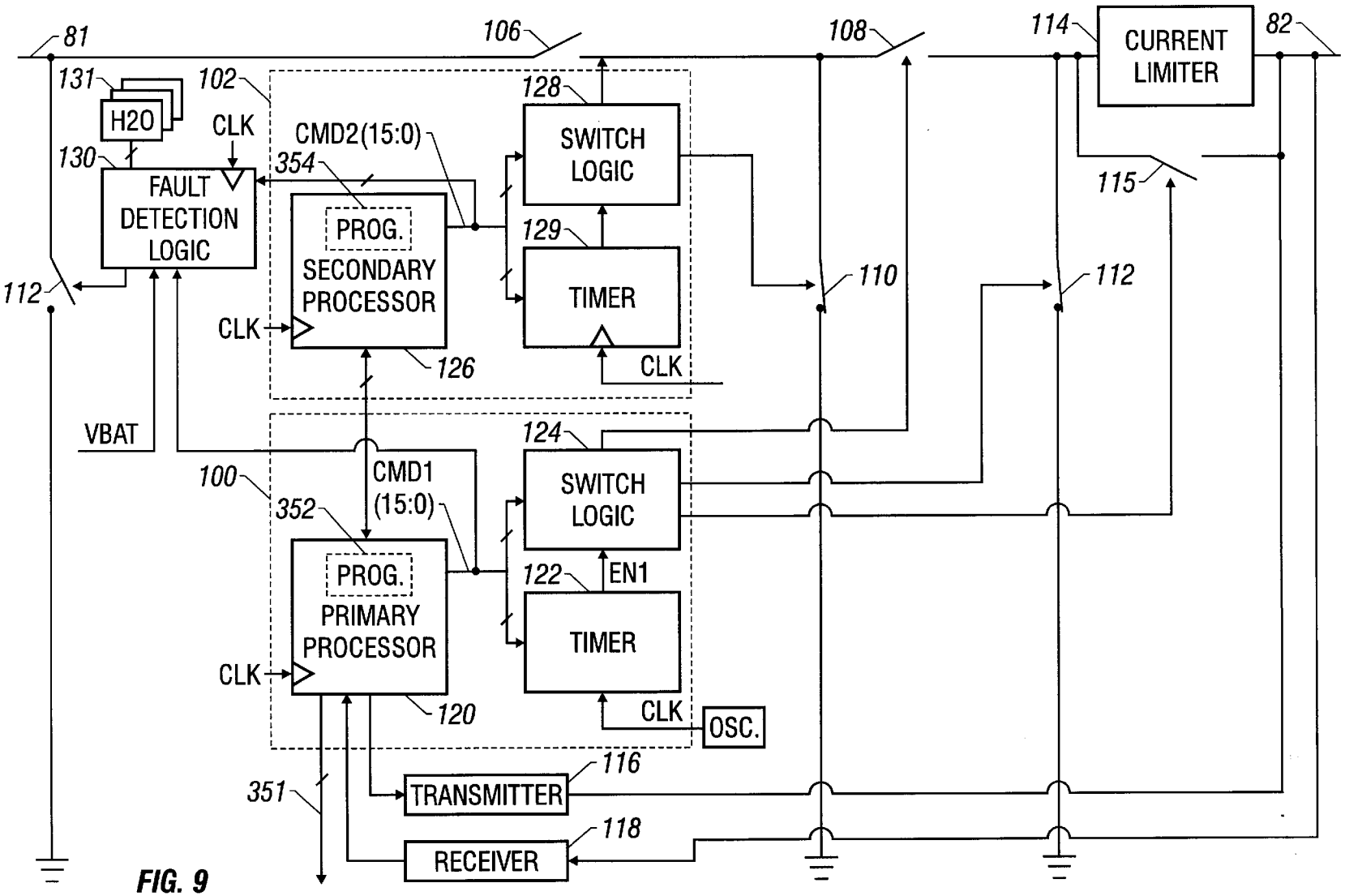
FIG. 9 is an electrical schematic diagram of the fire control circuit of FIG. 4.

Referring also to FIG. 9, after at least three fire control keys are generated, the fire control circuit 54 starts a sequence of events to connect the battery 52 to the power line 82. When a primary processor 120 and a secondary processor 126 have generated at least three keys that may or may not be valid keys, the processors each send out the first key each to start associated synchronous timers, 122 and 129, respectively. Immediately thereafter, the processors 120 and 126 each start firmware timers. If the key was invalid, the hardware will terminate the sequence by blowing the fuse 80 between the battery 52 and fire control circuit 54. If the key was valid, a certain time later, for example 32 seconds, the processors 120 and 126 send out the second key each. If the key is invalid, the hardware will terminate the sequence by blowing the fuse 80 between the battery 52 and fire control circuit 54. If the key is valid, the key will open (unlock) shunt switch(es) 110 and 112 and a certain time later (10 milliseconds (ms), for example), the processors 120 and 126 each send out a third key. If the key is invalid, the hardware will terminate the sequence by blowing the fuse 80 between the battery 52 and fire control circuit 54. If the key is valid, the key will close series switches 106 and 108. The battery 52 is now connected to one of the detonators 56, as described below.

Once the battery 52 is connected, the fire control circuit 54 selectively and serially communicates with the detonators 56 (via the power line 82) to fire the guns 59. Besides selectively instructing the detonators 56 to fire the guns 59, the fire control circuit 54 may also selectively request and receive status information from the detonators 56. In some embodiments, the guns 59 may be sequentially fired, beginning with the gun 59 farthest from the surface of the well and ending with the gun 59 closest to the surface of the well. In some embodiments, if the closest gun 59 to the fire control circuit 54 is otherwise fired first, the detonation of the detonation cord and shape charges will cut the power line 82, and thus, no other gun can be fired. Each detonator 56 has a mechanism to electrically disconnect the power line 82 from the next gun 59 below.

Although other addressing schemes may be used, in some embodiments, the fire control circuit 54 may communicate with the initiation control circuit 61 of each detonator 56, one at a time, beginning with the initiation control circuit 61 nearest from the fire control circuit 54. Each initiation control circuit 61 has a switch **57*a* which serially couples the terminals of each initiation control circuit 61 to adjacent detonators 56 and a switch 57*b* to connect the power line 82 to circuitry of the initiation control circuit 61. The switches 57*a* and 57*b* closest to the fire control circuit 54 are connected to the power line 82**. Initially, all of the switches 57*a* are open which permits the fire control circuit 54 to connect the battery 52 (via the appropriate switch 57*b*) to communicate with the nearest detonator 56 first.

In communicating with one of the detonators 56, the fire control circuit 54 either fires the perforating gun 59 associated with the detonator 56 or selects the next detonator 56. When the next gun is selected, the switch 57*a* of the currently selected detonator 56 closes, and the switch 57*b* of the currently selected detonator 56 opens. In some embodiments, the above-described process may be used to find the bottom gun 59 and fire this gun 59 first.

Referring to FIG. 5, in some embodiments, the initiation control circuit 61 may perform many operations in response to many different types of commands, which include, as examples, control commands and test commands. Control commands such as ID, NEXT_GUN, and FIRE_GUN, in some embodiments, control primary downhole functions.

The fire control circuit 54 sends either the FIRE_GUN command to actuate the initiation control circuit 61 or the NEXT_GUN command to deselect the initiation control circuit 61 that is currently coupled to the fire control circuit 54. Next, the fire control circuit 54 selects the next farther away (as measured from the fire control circuit 54) initiation control circuit 61 from the deselected initiation control circuit 61. After the bottom gun 59 is found, the fire control circuit 54 transmits the FIRE_GUN command. After the selected initiation control circuit 61 fires the associated perforating gun 59, a new detonation command must be received by the fire control circuit 54 and processed using the above-described technique before firing the next available perforating gun 59.

Referring to FIGS. 6 and 7, the initiation control circuit 61 may, in communications with the fire control circuit 54, communicate status information. After the fire control circuit 54 has detected a valid detonation command and the battery 52 is connected to one of the detonators 56, the initiation control circuit 61, when selected, commnunicates a PRESENCE status to the fire control circuit 54 acknowledging presence and readiness for a command. The detonator 56 closest to the fire control circuit 54 is selected by default while all others are selected by command. Each command issued by the fire control circuit 54 is answered by the initiation control circuit 61 with an appropriate STATUS or an ERROR STATUS. The primary downhole command acknowledge responses are for ID, NEXT_GUN, FIRE_GUN, and for initiation control circuit error. All other acknowledge responses are for function testing. The ID command initiates an identification (ID) status which causes the initiation control circuit 61 to transmit an acknowledge response, a year and week that the module was manufactured, an indication of a serial number, an indication of a version of the firmware, and a checksum for correct transmission detection.

The NEXT command initiates a bypass of the initiation control circuit 61, and as a result, the next detonator 56 further form the fire control circuit 54 is selected. The FIRE_GUN command initiates the firing of the associated perforating gun 59. A status is always sent to acknowledge the reception of a command before the initiation control circuit 61 executes the command. A time delay is incorporated between the status acknowledging the reception of a command and the execution of the command by the initiation control circuit 61 which permits the fire control circuit 54 to terminate the execution of the command if the command is incorrect. If the initiation control circuit 61 receives an invalid command, the initiation control circuit 61 returns an ERROR status.

Figure 8:
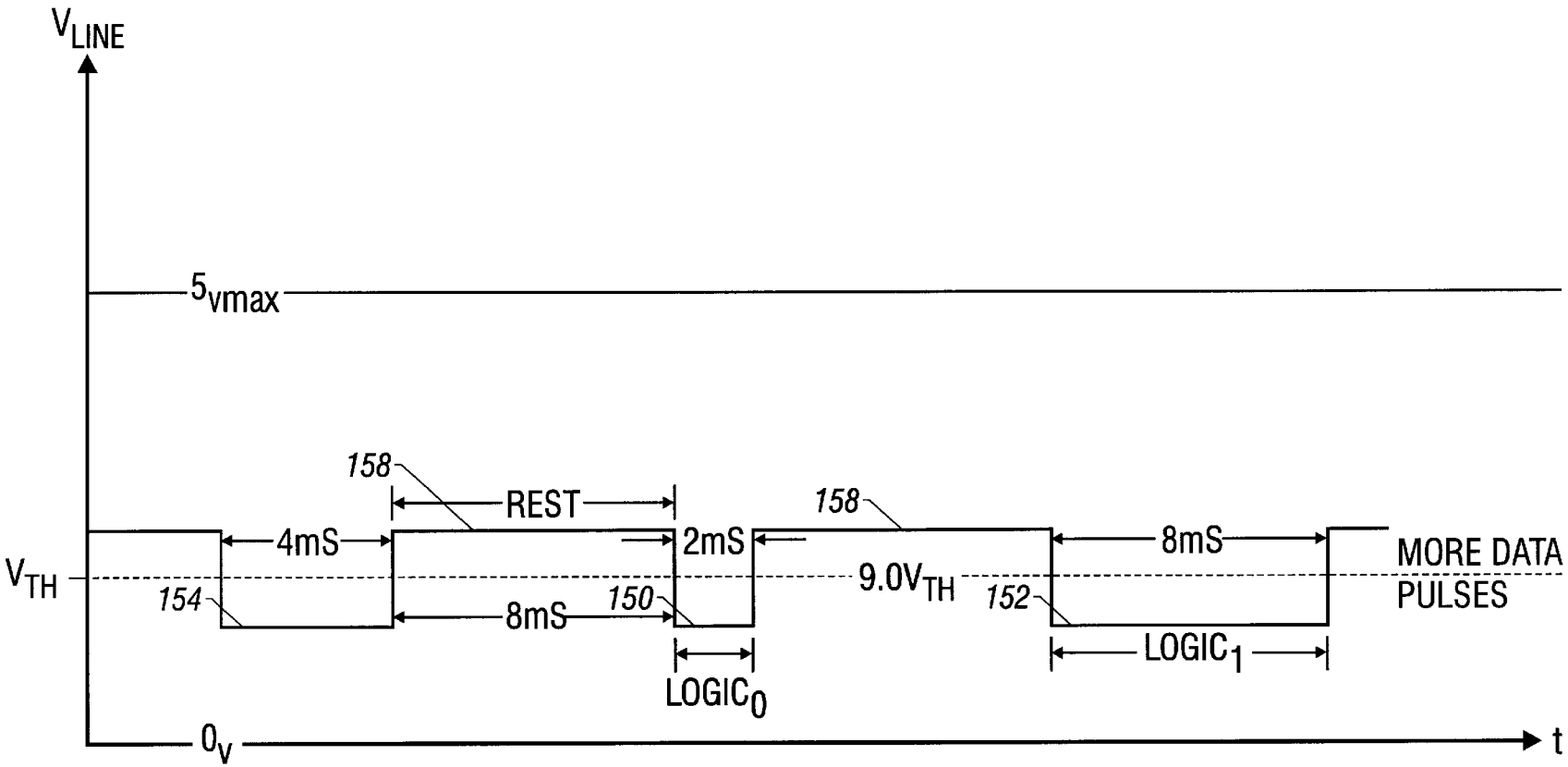
FIG. 8 is a waveform of a signal illustrating a communication protocol between the fire control circuit and the detonators.

Referring to FIG. 8, for communication purposes, a voltage level $V_{LINE}$ of the power line 82 is biased at a threshold voltage level $V_{TH}$ (e.g., nine volts). A logic zero corresponds to the voltage level $V_{LINE}$ being below the voltage level $V_{TH}$ (e.g., eight volts), and a logic one corresponds to the voltage $V_{LINE}$ being above the voltage $V_{TH}$ (e.g., ten volts). Besides the logical voltage levels, several other measures are in place to maximize the accuracy of serial communications with the detonators 56. For example, the duration of a logic zero pulse 150 is one third the duration of a logic one pulse 152. All pulses (i.e., logic one or logic zero pulses) are separated by a separation pulse (a pulse having a logic one voltage level) that has a duration equal to sum of the durations of the logic zero 150 and logic one 152 pulses. The voltage level $V_{LINE}$ is normally at the logical one level if the line 82 is not negated (i.e., pulled to the logic zero voltage level) by one of the detonators 56 or the fire control circuit 54. To indicate the beginning of a serial transmission, the line 82 is negated for a start pulse 154 that is twice the duration of the logic zero pulse 150.

Referring to FIG. 9, to minimize the possibility of connection of the battery 52 to the detonators 56 due to partial or total failure of the fire control circuit 54, the fire control circuit 54 has two circuits 100 and 102 which must both independently verify reception of the detonation command before the battery 52 is connected to the detonators 56. In this manner, no perforating guns 59 may be fired if one of the circuits 100 or 102 fails and incorrectly verifies reception of the detonation command. To accomplish this, the circuit 100 controls a switch 108 that is coupled in series with the battery 52 (and line 82) and a switch 112 that is coupled in parallel with the battery 52. Similarly, the circuit 102 controls a switch 106 that is coupled in series with the battery 52 (and line 82) and a switch 110 that is coupled in parallel with the battery 52. Thus, to connect the battery 52 to the detonators 56, the parallel switches 110 and 112 must be opened, and subsequently, the series switches 106 and 108 must be closed.

After initial power-up of the circuitry of the tool, the circuits 100 and 102 enter a safe state (the state of the fire control circuit 54 before the tool is lowered downhole) in which the circuits 100 and 102 ensure that the series switches 106 and 108 are open and the shunt switches 110 and 112 are closed. The circuits 100 and 102 remain in the safe state (assuming no malfinction in the fire control circuit 54 occurs) until the circuits 100 and 102 open the parallel switches 110 and 112 and close the series switches 106 and 108. If both circuits 100 and 102 do not enter the safe state after reset, fault detection logic 130 closes another switch 112 (normally open) that is in parallel with the battery 52 to blow the fuse 80 (see FIG. 4).

The circuit 100 has the processor 120 (an eight bit microcontroller, for example) that interacts with the sensor (s) 53 to detect the stimuli transmitted downhole. Based on the detected stimuli, the processor 120 extracts the command(s) transmitted from the surface of the well and thus, eventually extracts the detonation command.

Figure 10:
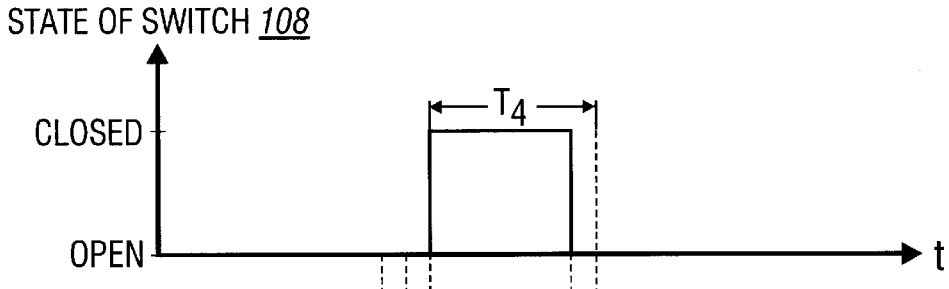
FIGS. 10, 11 and 12 are timing diagrams illustrating signals generated by the fire control circuit.
Figure 11:
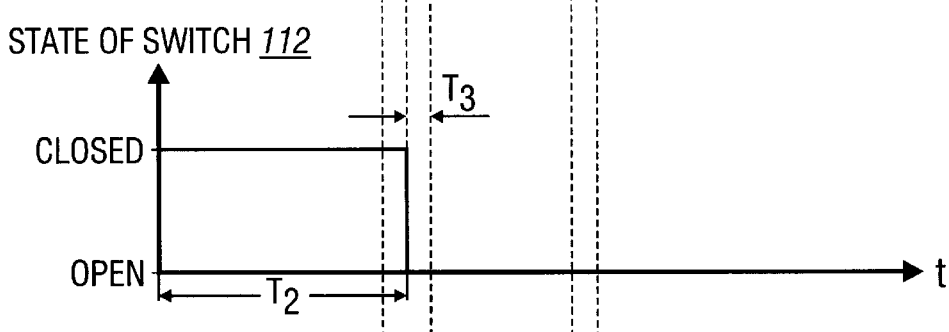
Figure 12:
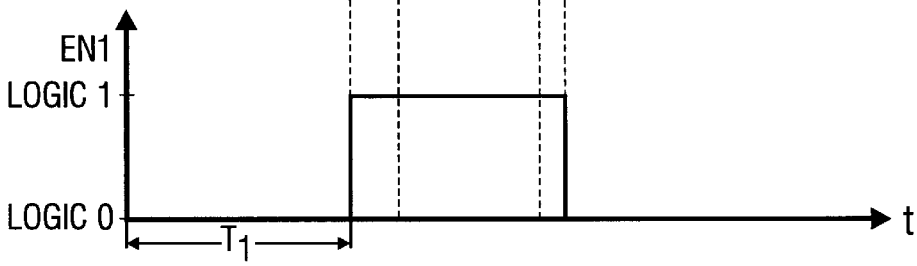

Referring also to FIGS. 10, 11 and 12, to ensure that the processor 120 is not malfunctioning, the circuit 100 has a timer 122 that is used to establish a time interval window 140 (as indicated by an output signal of the timer 122 called EN1) of a predetermined duration (e.g., sixty-four seconds) in which the battery 52 is to be connected to the detonators 56 (i.e., switch 108 is closed and switch 112 is opened) and in which the perforating guns 59 are to be fired. When the processor 120 detects the detonation command, the processor 120 enables the timer 122 to measure a time interval T1 of a predetermined duration (e.g., sixty-four seconds). The window 140 begins (as indicated by the assertion of the EN1 signal) when the time interval T1 elapses.

While the timer 122 is measuring the time interval T1, the processor 120 is internally and independently measuring another time interval T2 of a predetermined duration (e.g., sixty-five seconds) that is slightly longer in duration (e.g., one second longer) than the time interval T1. At the end of the time interval T2, the processor 120 attempts to open the parallel switch 112. If the window 140 exists, switch logic 124 allows the processor 120 to open the parallel switch 112. Otherwise, the switch logic 124 keeps the parallel switch closed 112.

After the time interval T2 elapses, the processor 120 measures another successive time interval T3 of a predetermined duration sufficient to allow the parallel switch 112 to open (e.g., 10 $\mu$s) before attempting to close the series switch 108. If the window 140 exists, the switch logic 124 allows the processor 120 to close the series switch 108. Otherwise, the switch logic 124 keeps the series switch 108 open.

After the time interval T3 elapses, the processor 120 measures another successive time interval T4 of a predetermined duration (e.g., thirty-one seconds) which is equivalent to the time left in the window 140. Just before (e.g., 10 $\mu$s before) the time interval T4 elapses, the processor 120 opens the series switch 108 (if not already open). When the time interval T4 expires, the processor 120 closes the parallel 112 (if not already closed) which returns the circuit 100 to the safe state.

The circuit 102 has a processor 126, switch logic 128, and a timer 129 that behave similarly to the processor 120, switch logic 124, and timer 122, respectively, to control the series switch 106 and the parallel switch 110. Instead of monitoring the output of the sensor 53 directly, the processor 126 receives an indication of the output of the sensor 53 from the processor 120 and independently verifies the signature of the pulses present in the hydrostatic fluid in the annulus 46 to extract commands sent from the surface of the well.

To verify that both circuits 100 and 102 come up in the safe state after power up of the fire control circuit 54, the fault detection logic 130 monitors the outputs (CMD1[15:0] and CMD2[15:0]) of the processors 120 and 126 to ensure these outputs indicate the processors 120 and 126 are in the safe state (e.g., "10100101b," wherein the suffix "b" denotes a binary representation). The fault detection logic 130 also monitors the output of an oscillator 115 which is used to clock the counters 122 and 129 and the processors 120 and 126. In this manner, if the fault detection logic 130 detects failure of the oscillator 115, the fault detection logic 130 closes the parallel switch 112 which blows the fuse 80. As a result, if the oscillator 115 temporarily fails while the tool 50 is downhole and the fire control circuit 54 is not in the safe state, the battery 52 does remain connected to any of the detonators 56 should the oscillator 115 revive after the tool 50 is brought to the surface. The fault detection logic 130 also receives the outputs of several water sensors 131 selectively placed around the circuitry of the tool 50. In this manner, if water is detected in the presence of the circuitry of the tool 50, the fault detection logic 130 closes the parallel switch 112 and blows the fuse 80. The fault detection logic 130 also monitors the terminal voltage of the battery 52 (as indicated by a signal called $V_{BAT}$) and closes the switch 112 should the terminal voltage exceed predetermined limits.

The fire control circuit 54 has a transmitter 116 and a receiver 118 which the processor 120 uses to serially communicate over the line 82 with the initiation control circuits 61 of the detonators 56. The input of the receiver 118 and the output of the transmitter 116 are connected to the output side of a current limiter 114 that is serially coupled between switch 108 and line 82. When fire control circuit 54 has completed the communication protocol, fire control circuit 54 applies full battery 52 power to initiation control circuits 61 by closing a bypass switch 115 to fire the associated perforating gun 59.

Figure 13:
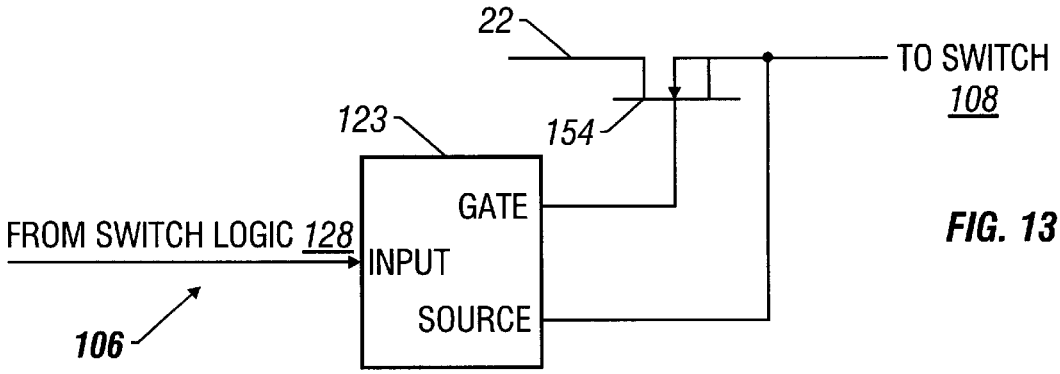
FIGS. 13 and 14 are alternative electrical schematic diagrams of a switch of FIG. 9.
Figure 14:
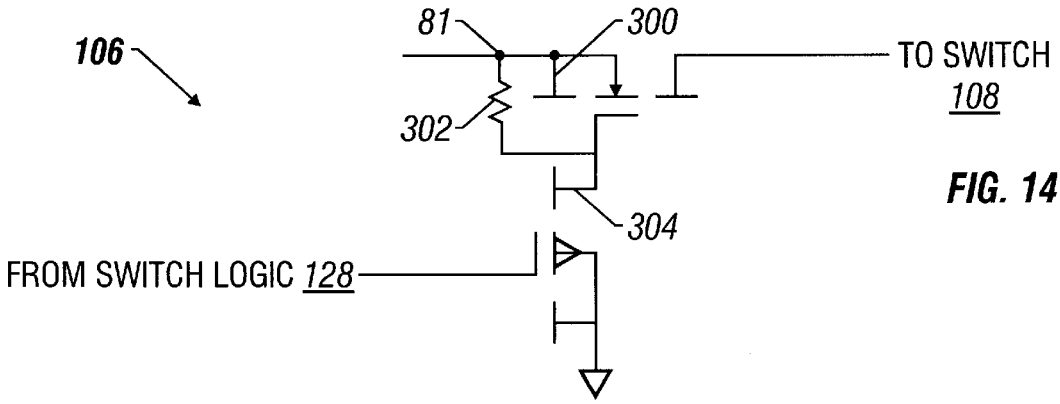

Referring to FIG. 13, as an example of the structure of the switches, the switch 106 may have a driver circuit 183 that has output terminals that are coupled to the gate and source of an n-channel metal oxide field-effect (NMOS) transistor 184. The current path of the transistor 184 is coupled between the line 81 and the current path of switch 108. The input of the drive circuit is connected to the switch logic 128.

Alternatively, as another example, the switch 106 may include an NMOS transistor 300 that has its drain-source path coupled between the line 81 and the switch 108. The gate-source voltage across the transistor 300 may be established by a resistor 302 that has one terminal coupled to the gate and one terminal coupled to the source of the transistor 300. Another NMOS transistor 304 of the switch 106 may have its drain-source path coupled between the gate of the transistor 300 and ground. The gate of the transistor 304 may be coupled to the switch logic 128.

The other switches 108, 110 and 112 may be constructed in a similar manner to the switch 106. Each switch 106, 108, 110, 112 has two states: an open state (in which the switch does not conduct) and a closed state (in which the switch conducts). The connection (i.e., a serial connection or a parallel connection) of the switch 106, 108, 110, 112 governs which state of a particular switch permits energy to flow from the battery 52 to the detonator 56.

Figure 15:
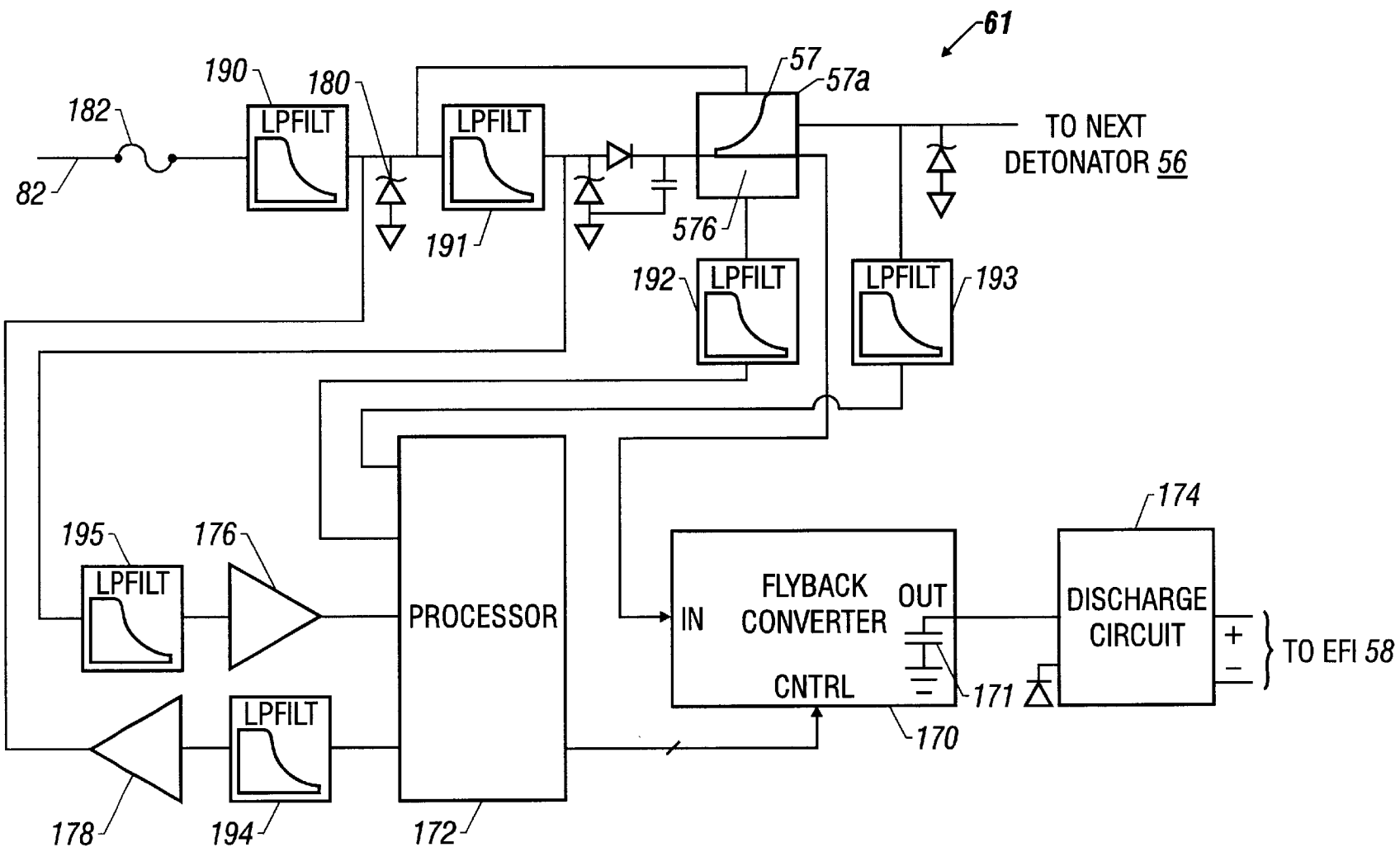
FIG. 15 is an electrical schematic diagram of the initiation control circuit of FIG. 4.

Referring to FIG. 15, in some embodiments, each initiation control circuit 61 may have a processor 172 that controls a switch circuit 57 (including the switches 57*a* and 57*b*) as well as operations of a fly-back, switching converter 170 (used to boost the voltage of the battery 52) and communications with the fire control circuit 54. The communications of the initiation control circuit 61 are accomplished via a receiver 176 and a transmitter 178 which are coupled to the line 82 and the processor 172.

When power is applied to initiation control circuits 61, the default setting of switch 57*a* is open to disconnect the initiation control circuit 61 from the other detonators 56, and the switch 57*b* is closed to power the immediate initiation control circuits 61 when instructed to do so by the fire control circuit 54. When the switch circuit 57 opens the switch 57*a*, the switch circuit 57 also closes the switch 57*b* which connects the battery 52 to the converter 170. Upon this occurrence, the processor 172 interacts with the converter 170 to boost the terminal voltage level of the battery 52 to a higher voltage level which is present at the output of the converter 170. A discharge circuit 174 (a gas discharge tube, for example) discharges an output capacitor 171 of the converter 170 when the output voltage of the converter 170 reaches a predetermined level (three thousand volts, for example). In this manner, the discharge circuit 174 transfers energy from the capacitor 171 to activate the EFI 58. Once activated, the EFI 58 initiates a shockwave in the detonator cord 51.

To minimize unpredictable behavior of the initiation control circuit 61, the initiation control circuit 61, in some embodiments, includes six low pass filters 10, 191, 192, 193, 194 and 195 that are selectively placed around the circuitry of the initiation control circuit 61 to reduce the level of any stray radio frequency (RF) signals. The initiation control circuit 61 also has an in-line fuse 182 coupled in series with the battery 52 and a Zener diode 180 shunted to ground to guard against such possibilities as the polarity or voltage level of the battery 52 being incorrect.

Figure 16:
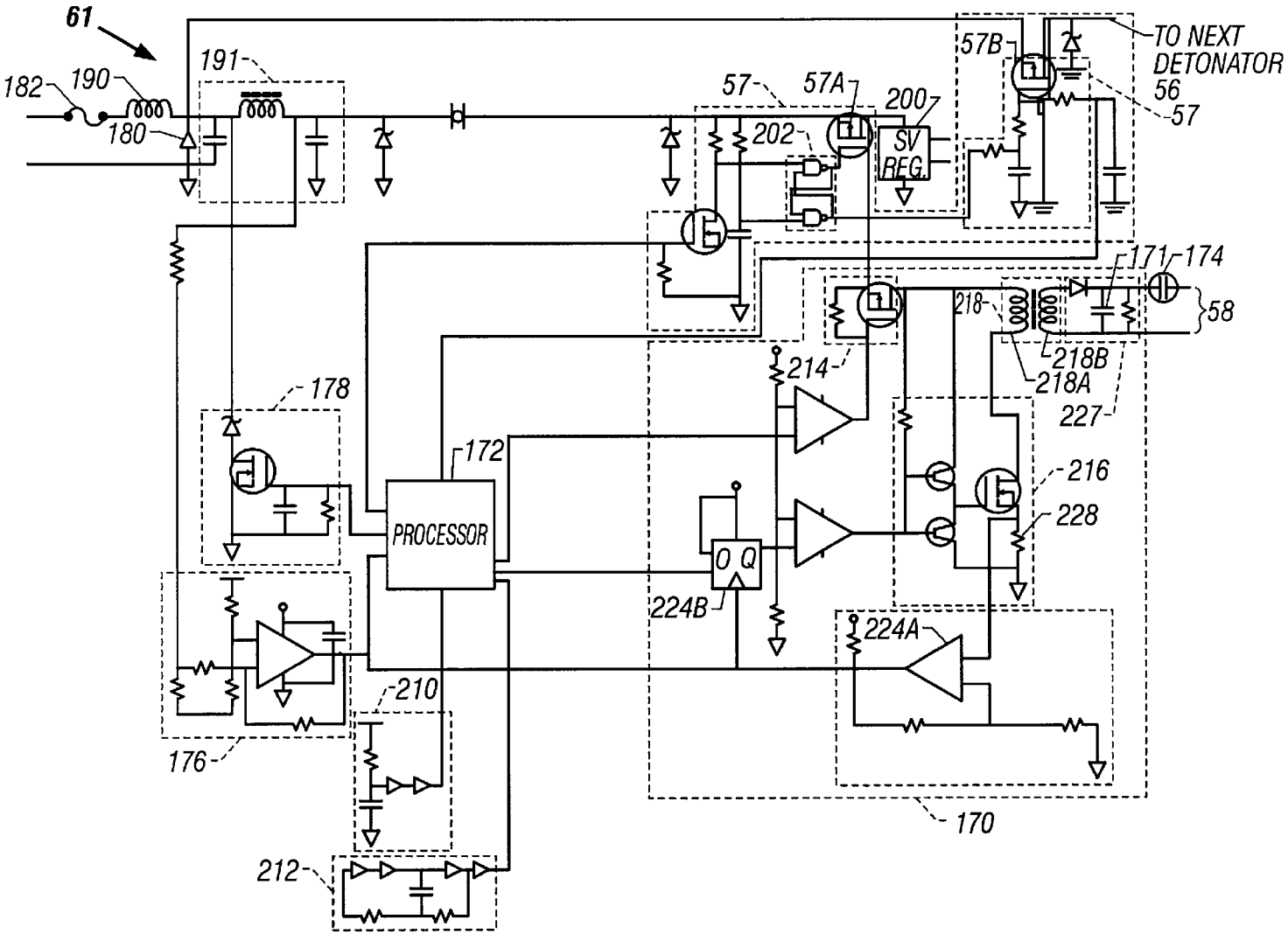
FIG. 16 is a more detailed electrical schematic diagram of the initiation control circuit of FIG. 15.

Referring to FIG. 16, the processor 172 may control the fly-back converter 170 by using two switches 214 and 216 to switch current through a primary winding 218*a* of a transformer 218 of the converter 170. The switch 214 may be a simple redundant (backup safety switch) that is switched on and off by the processor 172.

The processor 172 closes the switch 216 (i.e., turns on current in the primary winding 218*a*) at a predetermined rate by a clocking latch 224*b*. A sensing resistor 228 is coupled to the input of a comparator 224*a* which provides a reset to a latch 224*b* when the current in the primary winding 218*a* exceeds a predetermined threshold level. Upon this occurrence, the latch 224*b* opens the switch 216 which turns off current in the primary winding 218*a*. Subsequently, after waiting a predetermined duration, the processor 172 closes the switch 216 and repeats the above-described control process.

When current in the primary winding 218*a* is disrupted (i.e., by the opening of the switch 216), the energy stored in the transformer 218 is transferred to a secondary circuit 222 (having the capacitor 171) that is coupled to a secondary winding 218*b* of the transformer 218. On each power cycle of the converter 170, additional energy (corresponding to a step up in the voltage level of the capacitor 171) is transferred to the capacitor 171. When the voltage level of the capacitor 171 is large enough to activate the discharge circuit 174, the EFI 58 is activated which sends a shockwave down the detonator cord 51.

The switch circuit 57 has a two NAND gate latch 202 which controls the switches 57*a* and 57*b*. On power up, switch 57*a* is closed and switch 57*b* is open by default. In some embodiments, the processor 172 can only change the state of latch 202 to open switch 57*a* and close 57*b*. Only a new power up cycle can reset the latch 202. Once the switch 57*a* is open, no power is available for processor 172 to control anything.

The initiation control circuit 61 also has an RC ring-type oscillator 212 which provides a clock signal used by the circuitry of the initiation control circuit 61. A reset circuit 210 momentarily places the processor 172 in reset after power up of the initiation control circuit 61. The initiation control circuit 61 has a voltage regulator 200 to furnish direct current (DC) voltage for the logic of the initiation control circuit 61.

Other embodiments are within the scope of the following claims. For example, the initiation control circuit 61 may fire downhole devices other than the associated perforating gun 59, such as a single shot device (a packer, for example).

While the invention has been disclosed with respect to a limited number of embodiments, those skilled in the art, having the benefit of this disclosure, will appreciate numerous modifications and variations therefrom. It is intended that the appended claims cover all such modifications and variations as fall within the true spirit and scope of the invention.

What is claimed is:

1. An apparatus for use in a subterranean well, comprising:

a downhole energy source;

at least two controllers, each controller independently detecting a predetermined stimulus transmitted from the surface of the well; and a detonator to receive the energy from the energy source when each of the at least two controllers detects the predetermined stimulus.

2. The apparatus of claim 1, wherein the energy source comprises a battery.

3. The apparatus of claim 1, wherein the controllers are adapted to prevent the transfer of energy from the energy source to the detonator if all of the controllers do not indicate detection of the predetermined stimulus within a predetermined window of time.

4. The apparatus of claim 1, further comprising:

switches coupled between the detonator and the energy source in series, wherein each of the controllers operates a different one of the switches based on the detection of the predetermined stimulus by said each of the controllers.

5. The apparatus of claim 1, further comprising:

an explosive charge; and a detonator cord for transmitting a shockwave to the explosive charge, wherein the detonator initiates the shockwave after receiving energy from the energy source.

6. The apparatus of claim 1, wherein at least one of the controllers comprises:

a processor to:

detect the predetermined stimulus, and measure a first predetermined time interval from when said at least one of the controllers detects the predetermined stimulus;

a timer to measure a second predetermined time interval from when the stimulus is first detected; and logic connected to indicate detection of the predetermined stimulus in response to the measurement of the first and second predetermined time intervals.

7. The apparatus of claim 6, further comprising:

a switch coupled between the energy source and the detonator and being adapted to operate in response to the indication from the logic.

8. The apparatus of claim 6, wherein the logic is further adapted to indicate detection of the predetermined stimulus only if completion of the measurement of both the first and second time intervals occur within a predetermined window of time.

9. The apparatus of claim 1, wherein the well includes an annulus having a fluid, and wherein the predetermined stimulus comprises at least one pressure pulse in the fluid.

10. An apparatus usable in a subterranean well, comprising:

a downhole energy source;

a detonator; and a circuit to couple the detonator to the downhole energy source in response to different subcircuits of the circuit independently detecting the presence of a predetermined stimulus communicated from a surface of the well.

11. The apparatus of claim 10, wherein at least one of the subcircuits comprises a controller to detect the stimulus.

12. The apparatus of claim 10, wherein the circuit comprises:

at least one switch to couple the detonator to the downhole energy source in response to the detection of the presence of the predetermined stimulus by the subcircuits.

13. The apparatus of claim 12, wherein said at least one switch comprises:

a first switch coupled between the downhole energy source and the detonator to transition to a first state to permit coupling of the downhole energy source to the detonator in response to the detection of the presence of the predetermined stimulus by one of the subcircuits; and a second switch coupled between the first switch and the detonator to transition to a second state to permit coupling of the downhole energy source to the detonator in response to the detection of the presence of the predetermined stimulus by one of the subcircuits.

14. The apparatus of claims 10, wherein the circuit is adapted to couple the detonator to the downhole energy source only if all of the different subcircuits indicate detection of the predetermined stimulus within a predetermined window of time.

15. An assembly, comprising:

a downhole energy source;

a detonator;

a tool to respond to detonation of the detonator; and a circuit to couple the detonator to the downhole energy source in response to different subcircuits of the circuit independently detecting the presence of a predetermined stimulus communicated from a surface of the well.

16. The assembly of claim 15, wherein the tool comprises a perforating gun.

17. The assembly of claim 15, wherein at least one of the subcircuits comprises a controller to detect the stimulus.

18. The assembly of claim 15, wherein the circuit comprises:

at least one switch to couple the detonator to the downhole energy source in response to the detection of the presence of the predetermined stimulus by the subcircuits.

19. The assembly of claim 18, wherein said at least one switch comprises:

a first switch coupled between the downhole energy source and the detonator to transition to a first state to permit coupling of the downhole energy source to the detonator in response to the detection of the presence of the predetermined stimulus by one of the subcircuits; and a second switch coupled between the first switch and the detonator to transition to a second state to permit coupling of the downhole energy source to the detonator in response to the detection of the presence of the predetermined stimulus by one of the subcircuits.

20. The assembly of claim 15, wherein the circuit is adapted to couple the detonator to the downhole energy source only if all of the different subcircuits indicate detection of the predetermined stimulus within a predetermined window of time.

21. An apparatus for use in a subterranean well, comprising:

a downhole energy source;

at least two controllers, each controller independently detecting a predetermined stimulus transmitted from the surface of the well;

a detonator to receive the energy from the energy source when each of the at least two controllers detects the predetermined stimulus; and a switch coupled between the detonator and the energy source, wherein one of the controllers is adapted to cause the switch to remain in a state to couple the detonator to the energy source for a first predetermined duration of time after detection of the predetermined stimulus by said one of the controllers.

22. The apparatus of claim 21, wherein the controllers are adapted to prevent the transfer of energy from the energy source to the detonator if all of the controllers do not indicate detection of the predetermined stimulus within a predetermined window of time.

23. The apparatus of claim 21, further comprising:

switches coupled between the detonator and the energy source in series, wherein each of the controllers operates a different one of the switches based on the detection of the predetermined stimulus by said each of the controllers.

24. The apparatus of claim 21, further comprising:

an explosive charge; and a detonator cord for transmitting a shockwave to the explosive charge, wherein the detonator initiates the shockwave after receiving energy from the energy source.

25. The apparatus of claim 21, wherein at least one of the controllers comprises:

a processor to:

detect the predetermined stimulus, and measure a first predetermined time interval from when said at least one of the controllers detects the predetermined stimulus;

a timer to measure a second predetermined time interval from when the stimulus is first detected; and logic connected to indicate detection of the predetermined stimulus in response to the measurement of the first and second predetermined time intervals.

26. The apparatus of claim 25, further comprising:

a switch coupled between the energy source and the detonator and being adapted to operate in response to the indication from the logic.

27. The apparatus of claim 25, wherein the logic is further adapted to indicate detection of the predetermined stimulus only if completion of the measurement of both the first and second time intervals occur within a predetermined window of time.

28. The apparatus of claim 21, wherein the well includes an annulus having a fluid, and wherein the predetermined stimulus comprises at least one pressure pulse in the fluid.

29. The apparatus of claim 21, wherein the energy source comprises a battery.

* * * * *